US008607862B2

(12) United States Patent
Diehl et al.

(10) Patent No.: US 8,607,862 B2
(45) Date of Patent: Dec. 17, 2013

(54) METHOD AND DEVICE FOR IN-SITU CONVEYING OF BITUMEN OR VERY HEAVY OIL

(75) Inventors: Dirk Diehl, Erlangen (DE); Norbert Huber, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 445 days.

(21) Appl. No.: 12/990,950

(22) PCT Filed: Apr. 30, 2009

(86) PCT No.: PCT/EP2009/055297

§ 371 (c)(1),
(2), (4) Date: Nov. 4, 2010

(87) PCT Pub. No.: WO2009/135806

PCT Pub. Date: Nov. 12, 2009

(65) Prior Publication Data

US 2011/0048717 A1 Mar. 3, 2011

(30) Foreign Application Priority Data

May 5, 2008 (DE) ..... 10 2008 022 176

(51) Int. Cl.
*E21B 36/04* (2006.01)
*E21B 43/24* (2006.01)

(52) U.S. Cl.
USPC ..... 166/248; 166/60; 166/65.1; 166/302

(58) Field of Classification Search
None
See application file for complete search history.

(56) References Cited

U.S. PATENT DOCUMENTS

| | | | | |
|---|---|---|---|---|
| 4,116,273 | A * | 9/1978 | Fisher et al. | 166/248 |
| 4,373,581 | A | 2/1983 | Toellner | |
| 4,645,004 | A | 2/1987 | Bridges et al. | |
| 4,886,118 | A * | 12/1989 | Van Meurs et al. | 166/245 |
| 5,449,251 | A | 9/1995 | Daily et al. | |
| 5,898,579 | A | 4/1999 | Boys et al. | |
| 6,617,556 | B1 | 9/2003 | Wedel | |
| 8,091,632 | B2 * | 1/2012 | Diehl et al. | 166/248 |
| 8,371,371 | B2 * | 2/2013 | Diehl et al. | 166/60 |
| 2006/0151166 | A1 * | 7/2006 | Montgomery et al. | 166/245 |
| 2010/0108318 | A1 * | 5/2010 | Diehl et al. | 166/272.3 |
| 2011/0042063 | A1 * | 2/2011 | Diehl et al. | 166/60 |

FOREIGN PATENT DOCUMENTS

| | | | |
|---|---|---|---|
| DE | 10 2004 009 896 | A1 | 9/2005 |
| DE | 10 2007 008 292 | A1 | 8/2008 |
| DE | 10 2007 009 192.6 | | 8/2008 |
| DE | 10 2007 040 605 | B4 | 10/2008 |
| DE | 10 2007 036 832 | A1 | 2/2009 |
| EP | 9190 | B1 | 12/2007 |
| RU | 2292676 | C2 | 1/2007 |
| RU | 2303693 | C2 | 7/2007 |

* cited by examiner

*Primary Examiner* — George Suchfield

(57) ABSTRACT

A method is for conveying bitumen or heavy oil in a deposit is provided. The bitumen or very heavy oil is liquefied by way of an inductive conductor loop as a heater and is led away using an extraction pipe, wherein the conductor loop and the extraction pipe are disposed relative to one another such that the heating and thus extraction of bitumen or very heavy oil is maximized. To this end, one of the conductors of the conductor loop is disposed substantially vertically above the extraction pipe.

16 Claims, 4 Drawing Sheets

METHOD AND DEVICE FOR IN-SITU CONVEYING OF BITUMEN OR VERY HEAVY OIL

CROSS REFERENCE TO RELATED APPLICATIONS

This application is the US National Stage of International Application No. PCT/EP2009/055297, filed Apr. 30, 2009 and claims the benefit thereof. The International Application claims the benefits of German application No. 10 2008 022 176.7 DE filed May 5, 2008. All of the applications are incorporated by reference herein in their entirety.

FIELD OF INVENTION

The invention relates to a method for "in-situ" conveying of bitumen or very heavy oil from oil sand deposits according to the preamble of the claims. Furthermore, the invention relates to an associated apparatus for implementing the method.

BACKGROUND OF INVENTION

The German patent according to DE 10 2007 040 605 B4 with the title "Apparatus for "in-situ" conveying of bitumen or very heavy oil", grants protection to an apparatus with which thermal energy is applied to the oil sand deposit, referred to as reservoir, in order to reduce the viscosity of the bitumen or very heavy oil such that at least one electrical/electromagnetic heater is provided and an extraction pipe is present for leading away the liquefied bitumen or very heavy oil, wherein at least two linearly extended conductors are routed in parallel in the horizontal alignment at the predetermined depth of the reservoir, with the ends of the conductors being electrically conductively connected inside or outside of the reservoir and together forming a conductor loop, which realizes a predetermined complex resistance and are connected outside of the reservoir to an external alternating current generator for electrical power, with the inductivity of the conductor loop being compensated section by section. The reservoir can therefore be heated inductively.

The conveying method forming the basis of the above patent originates from the known SAGD (Steam Assisted Gravity Drainage) method. The SAGD method starts by both pipes typically being heated by steam for three months, in order to liquefy the bitumen in the space between the pipes at least as quickly as possible. Steam is subsequently introduced into the reservoir through the upper pipe and the conveying through the lower pipe can begin.

With older, non pre-published German patent applications from the applicant (DE 10 2007 008 192.6 with the title "Apparatus and method for "in-situ" extraction of a substance containing hydrocarbon by reducing its viscosity from a subterranean deposit" and DE 10 2007 036 832.3 with the title "Apparatus for "in-situ" extraction of a substance containing hydrocarbon"), electrical/electromagnetic heating methods are already proposed for an "in-situ" conveying of bitumen and/or very heavy oil, in which an inductive heating of the reservoir in particular takes place.

"In-situ" extraction methods of bitumen from oil sands using steam and horizontal bore holes (SAGD) are used commercially. To this end, large quantities of water vapor are needed in order to heat up the bitumen and large quantities of water to be cleaned accumulate. Reference has already made in such cases to the possibility of the steam-free subterranean heating of the bitumen. Purely electrically-resistive bitumen heating for conveying purposes is likewise known.

SUMMARY OF INVENTION

Based on the afore-cited patent and the further prior art, it is the object of the invention to methodically improve the method and to create the associated apparatus.

The object is achieved in accordance with the invention by the measures of the claims. An associated apparatus forms the subject matter of the claims. Developments of the inventive method and the associated apparatus are specified in the dependent claims.

The subject matter of the invention is that a purely electromagnetic-inductive method for heating and conveying bitumen with particularly favorable arrangements of the inductors is proposed. It is essential here to position one of the inductors directly above the production pipe, in other words without any appreciable horizontal displacement. Nevertheless, a displacement when introducing the boreholes cannot be completely avoided. In each case the displacement should be smaller than 10 m, preferably smaller than 5 m, and this is considered to be insignificant in terms of the corresponding dimensions of the deposit.

This relates to the positioning of the inductors, which are decisive for a conveying method without steam, and to the electrical circuitry of the sub-conductors.

While, with the patent cited in the introduction, the electromagnetic heating process can be combined with a steam process (SAGD), the additional invention exclusively applies to the electromagnetic heating, which is subsequently referred to as EMGD (Electro-Magnetic Gravity Drainage) method. The EMGD method relates to the positioning of the inductors with individual sub-conductors, which are decisive for a conveying method without steam and to the electrical circuitry of the sub-conductors.

As a result of a number, especially three sub-conductors, being present, it is possible for instance to operate with single-phase alternating current at the start of the heating process, in order to heat the bitumen and/or very heavy oil in the vicinity of the production pipe as quickly as possible, in order then to switch to three-phase current and vice versa: The production can be maximized by means of a current feed which is suited to the heating system in each instance.

BRIEF DESCRIPTION OF THE DRAWINGS

Further details and advantages of the invention result from the subsequent description of the Figures of exemplary embodiments with the aid of the drawing in connection with the claims, in which;

The same or similarly operating units are provided with the same or corresponding reference characters in the Figures. The figures are subsequently described together in groups.

DETAILED DESCRIPTION OF INVENTION

Figure 1:
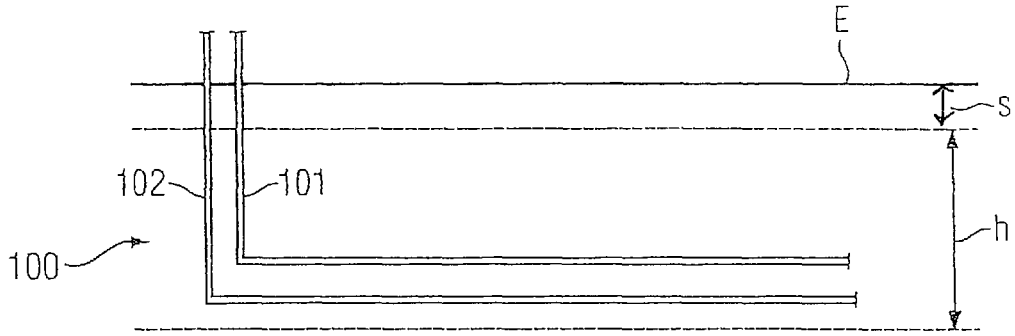
FIG 1 (Prior art)
FIG. 1 shows a schematic representation of a section through an oil sand reservoir with an injection and extraction pipe according to the prior art.
Figure 2:
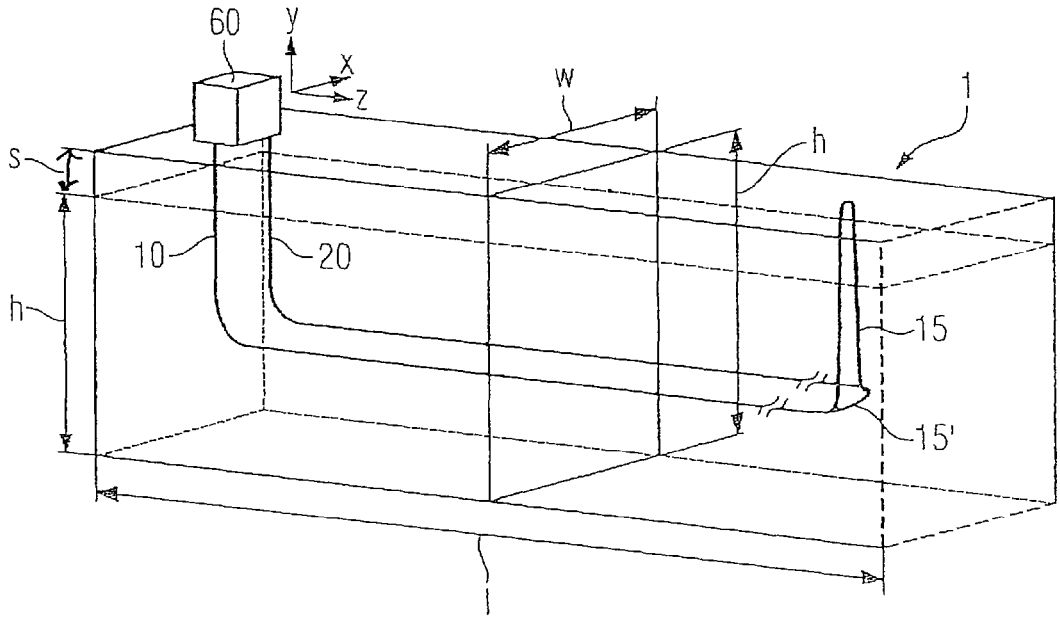
FIG. 2 shows a schematic representation of a perspective cutaway section of an oil sand reservoir having an electrical conductor loop running horizontally in the reservoir in accordance with the main patent application.

An oil sand deposit 100, referred to as reservoir, is shown in FIGS. 1 and 2, with the observations made below concentrating on a rectangular unit 1 having the length 1, the width w and the height h. The length 1 can amount to up to a few 500 m, the width w 60 to 100 m and the height h approximately 20 to 100 m. It should be noted that based on the Earth's surface, an "overburden" with a thickness s of up to 500 m may exist.

When realizing the SAGD method known from the prior art, in accordance with FIG. 1, an injection pipe 101 for steam or water/steam mixture and an extraction pipe 102 for the liquefied bitumen or oil exists in the oil sand reservoir 100 of the deposit.

FIG. 2 shows an arrangement for the inductive heater. This can be fanned by a long, i.e. some 100 m to 1.5 km, conductor loop 10 to 20 installed in the ground, with the forward conductor 10 and the return conductor 20 being routed adjacent to one another, in other words at the same depth, and being connected to one another at the end, inside or outside the reservoir, by way of an element 15. At the start, the conductors 10 and 20 are routed vertically downwards or at a shallow angle and are supplied with electrical power by a HF generator 60, which can be accommodated in an external housing. In particular, the conductors 10 and 20 run at the same depth either adjacent to one another or above one another. In this arrangement it is sensible for the conductors to be offset from one another.

Typical distances between the forward and return conductors 10, 20 are 10 to 60 m with an external diameter of the conductors of 10 to 50 cm (0.1 to 0.5 m).

An electrical two-wire line 10, 20 in FIG. 2 with the aforecited typical dimensions has a longitudinal inductive layer of 1.0 to 2.7 μH/m. The transverse capacitance amount is only around 10 to 100 pF/m with the cited dimensions, so that the capacitive transverse currents can initially be ignored. Wave effects are to be avoided here. The wave speed is provided by the capacitance and inductance amount of the conductor arrangement. The characteristic frequency of the arrangement is specified by the loop length and the wave propagation speed along the arrangement of the two-wire line 10, 20. The loop length should therefore be selected short enough for no interfering wave effects to result here.

The main patent application shows that the simulated power loss density allocation decreases radially in a plane at right angles to the conductors, as is embodied with the opposing-phase current feed of the upper and lower conductor.

The labels selected for FIG. 3, which in principle shows a combination of FIGS. 1 and 2 in the projection, are as follows:

0: section of an oil reservoir, is repeated a number of times towards both sides

1': horizontal pipe pair ("well pair"), with injection pipe a and production pipe b, equivalent to the extraction pipe 102 in FIG. 1, cross-sectional representation A: 1st horizontal, parallel inductor B: 2nd horizontal, parallel inductor

Figure 3:
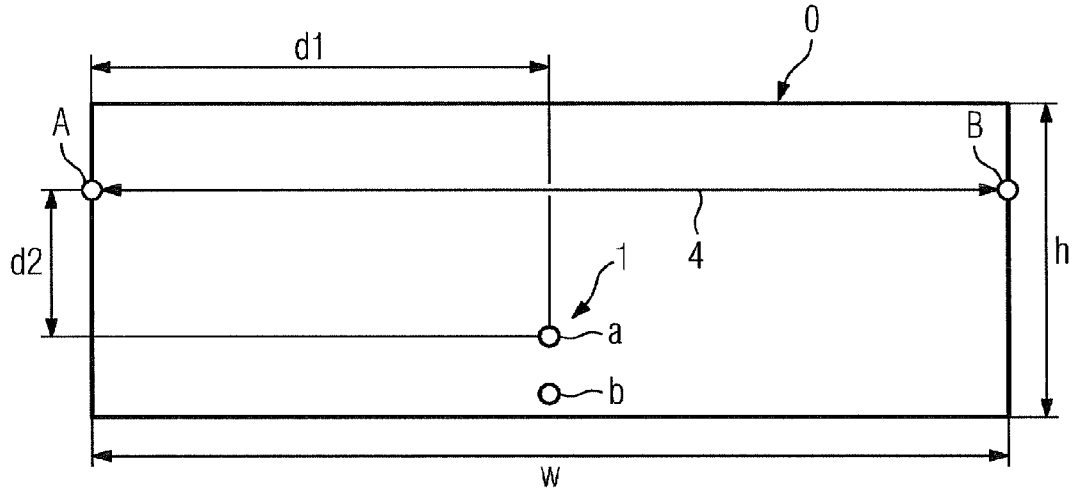
FIG. 3 shows a schematic representation of a combination of FIG. 1 and FIG. 2 indicating the prior art of the SAGD method with electromagnetic-inductive assistance.

4: inductive current feed by electrical connection to the ends of the inductors (according to FIG. 3)

w: reservoir width, distance from one well pair to the next (typically 50-200 m)

h: reservoir height, thickness of the geological oil layer (typically 20-60 m)

d1: horizontal distance from A to 1 is w/2 d2: vertical distance from A and B to a: 0.1 m to 0.9*h (typically 20 m-60 m).

An arrangement of the sub-conductor of the conductor loop directly above the production pipe, and essentially at a right angle above the production pipe, gives the particular advantage of the bitumen in the environment above the production pipe heating up over a comparatively short period of time and thus being at low viscosity. This means that production begins after a comparatively short period of time (e.g. 6 months), which coincides with a pressure relief of the reservoir. The pressure in a reservoir is typically limited and dependent on the thickness of the overburden, in order to prevent evaporated water from breaking through (e.g. 12 bar at a depth of 120 m, 40 bar at 400 m, . . . ). Since the pressure in the reservoir increases as a result of the electrical heating, the current distribution for heating purposes must take place in a pressure-controlled fashion. This again means that a higher heating output is only possible after production has started. The early conveying is enabled by the close arrangement of the inductors. A close attachment of two inductors operated in phase opposition, (180° phase displacement), which are contained in a conductor loop is not possible since the inductive heating output would then be significantly reduced and the necessary current distribution in the cable would be too great.

Figure 4:
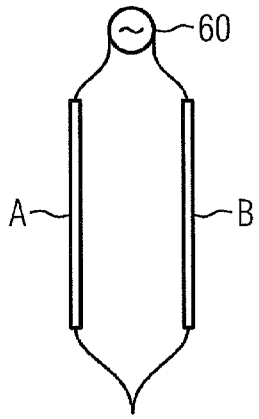
FIG. 4 shows a schematic representation of the electrical circuitry of the inductive sub-conductors in the case of two sub-conductors.
Figure 5:
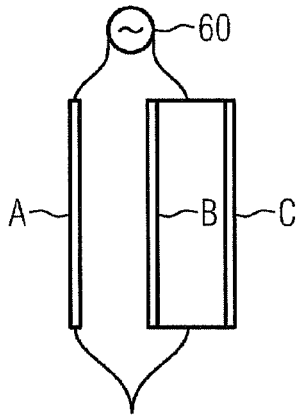
FIG. 5 shows a schematic representation of the electrical circuitry of the inductive sub-conductors in the case of three sub-conductors having a parallel circuit of two sub-conductors.
Figure 6:
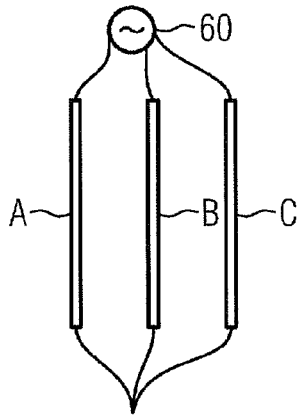
FIG. 6 shows a schematic representation of the electrical circuitry of the inductive sub-conductors with three sub-conductors having three-phase ac current and FIG. 7 to FIG. 10 show schematic representations of four variants of the new EMGD method with a different arrangement of inductors.

The associated electrical circuitry can be found in FIGS. 4 to 6. A distinction is to be made here as to whether two or three sub-conductors are present.

In FIG. 4, A is a first inductive sub-conductor (forward conductor) and B a second inductive sub-conductor (return conductor), to which a converter/high-frequency generator 60 from FIG. 2 is connected.

FIG. 5 shows a switching variant, in which three inductors are used, two of which carry half the current. In FIG. 5, A is a first inductive sub-conductor, B is a second inductive sub-conductor and C is a third inductive sub-conductor, with the sub-conductors B and C being connected in parallel. Other combinations of the sub-conductors are also possible. A converter/high frequency generator is available.

FIG. 6 shows a switching variant, in which three inductors are likewise used, which are however connected to a three-phase current generator and therefore all have the same current distribution with 120° phase displacement. In FIG. 6, A is a first inductive sub-conductor, B is a second inductive sub-conductor and C is a third inductive sub-conductor. All sub-conductors are connected to a three-phase current converter/high frequency generator.

The switching variants according to FIGS. 4 to 6 are used to realize the arrangements of the inductors in the reservoir which are subsequently described below with reference to FIGS. 7 to 10. An inductor, for instance an inductive sub-conductor A and/or A', is used as a forward conductor and an inductor B and/or B' is used as a return conductor, with forward and return conductors in this case carrying the same strength of current with a phase displacement of 180° with respect to the sectional images in FIGS. 7 and 8.

In accordance with FIG. 5, an inductor A can also be used as a forward conductor and two inductors B and C can be used as return conductors. The parallel—switched return conductors B, C in this case each carry half of the strength of current with 180° phase displacement relative to the current of the forward conductor A.

Finally, an inductor can be used as a forward conductor and more than two inductors can be used as return conductors, with the phase displacement of the currents of the forward conductor to all return conductors amounting to 180° and the total of the return line currents corresponding to the forward conductor current.

According to FIG. 6, three inductors A, B and C can carry the same intensity of current and the phase displacement between these can amount in each instance to 120°. The three inductors A, B, C are fed on the input side by an alternating current generator and are connected on the output side in a star point, which may lie inside or outside of the reservoir and corresponds to the connecting element 15. It is also possible here for the three inductors A, B and C to carry unequal strengths of current and have phase displacements other than 120°. Intensities of current and phase displacements are selected such that a circuit with a star point is enabled. In this case, the total of the forward line currents correspond at each point in time to the total of the return line currents.

Figure 7:
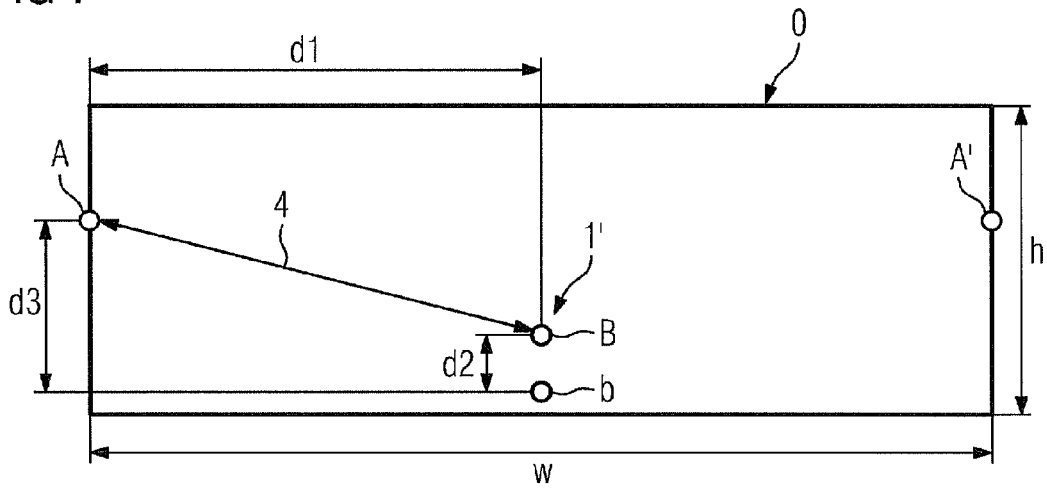

FIG. 7 shows a first advantageous embodiment of the invention for an EMGD method. A first inductor exists above the production pipe and a second inductor exists on the line of symmetry. The labels selected for the figure are as follows:

0: section of an oil reservoir, is repeated a number of times toward both sides
b: production pipe, cross-sectional representation
A: 1st horizontal, parallel inductor
B: 2nd horizontal, parallel inductor
A': 1st horizontal, parallel inductor of the adjacent reservoir section
4: inductive current feed by electrical connection to the ends of the inductors (according to FIG. 4)
w: reservoir width, distance from one well pair to the next (typically 50-200 m)
h: reservoir height, thickness of the geological oil layer (typically 20-60 m)
d1: horizontal distance from A to B (w/2)
d2: vertical distance from B to b: preferably 2 m to 20 m.
d3: vertical distance from A to b: preferably 10 m to 20 m.

Figure 8:
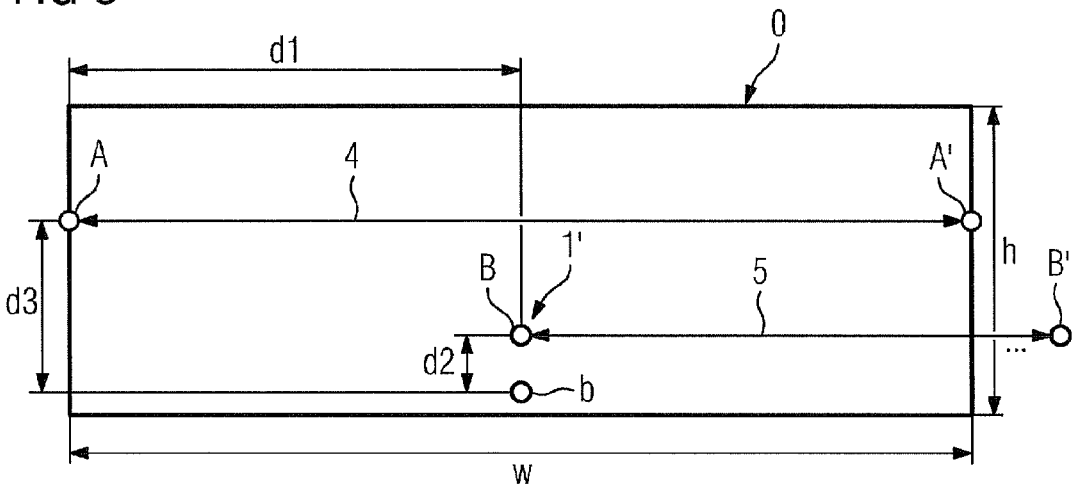

FIG. 8 shows a further advantageous embodiment of the invention for an EMGD method. A first inductor exists above the production pipe and a second inductor exists on the line of symmetry, but with two separate current circuits existing in deviation from FIG. 7. The labels selected for the figure are as follows:

0: section of an oil reservoir, is repeated a number of times toward both sides
b: production pipe, cross-sectional representation
A: 1st horizontal, parallel inductor
B: 2nd horizontal, parallel inductor
A': 1st horizontal parallel inductor of the adjacent reservoir section
B': 2nd horizontal parallel inductor of the adjacent reservoir section
4: inductive current feed by electrical connection to the ends of the inductors (according to FIG. 5)
w: reservoir width, distance from one well pair to the next (typically 50-200 m)
h: reservoir height, thickness of the geological oil layer (typically 20-60 m).
d1: horizontal distance from A to B (w/2)
d2: vertical distance from B to b: preferably 2 m to 20 m production pipe b
B: 2nd horizontal, parallel inductor
C: 3rd horizontal, parallel inductor
4: Inductive current feed by electrical connection to the ends of the inductors (according to FIG. 5 or 6)
w: reservoir width, distance from one well pair to the next (typically 50-200 m)
h: reservoir height, thickness of the geological oil layer (typically 20-60 m)
d1: horizontal distance from A to C and B to A (w/2)
d2: vertical distance from A to b: preferably 2 m to 20 m
d3: vertical distance from C and B to b: preferably 5 m to 20 m.

Different variants were described above which express the subject matter of the main patent application for the EMGD method in concrete terms. The following variants are regarded as particularly advantageous:

FIG. 7 with the switching variant according to FIG. 4. An inductor B is located above the production pipe b, the second inductor A is located on the boundary of symmetry relative to the adjacent partial reservoir.

FIG. 8 with two electric circuits and switching variants according to FIG. 4. Two inductors A and A' are located on the boundaries of symmetry relative to the adjacent partial reservoirs. Two inductors B and B' are located above the production pipe b and the production pipe of the adjacent partial reservoir (not shown here).

Figure 9:
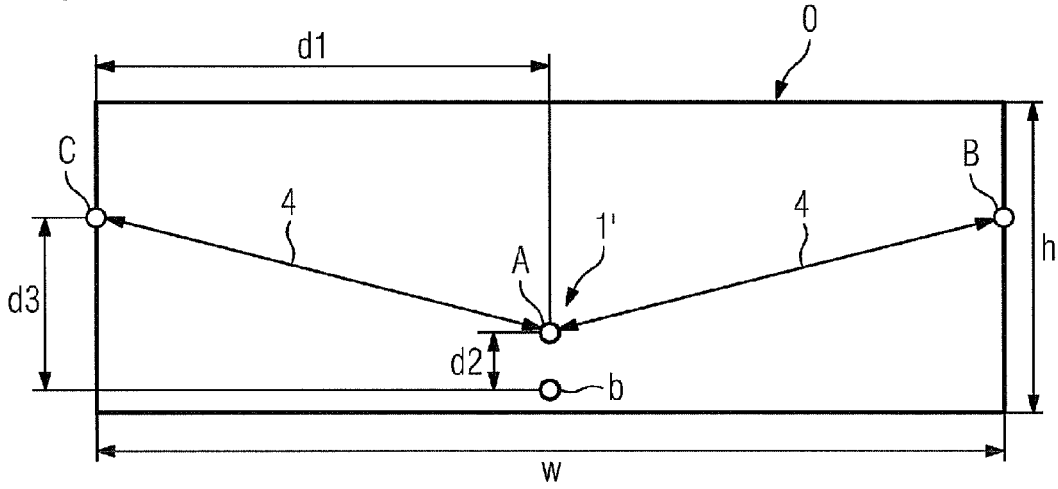

FIG. 9 with switching variants according to FIG. 5 or 6. An inductor A is located above the production pipe b, the second inductor B is located on the boundary of symmetry relative to the left adjacent partial reservoir. The third inductor C is located on the boundary of symmetry relative to the right adjacent partial reservoir.

Figure 10:
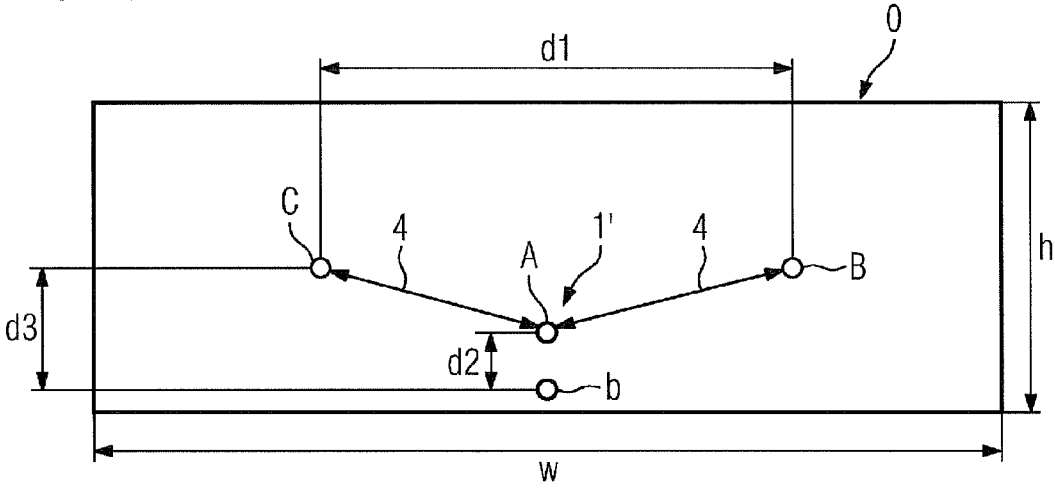

FIG. 10 with switching variants according to FIG. 5 or 6. An inductor A is located above the production pipe b, the second inductor B is located at a horizontal distance d1 from the latter. The third inductor C is likewise located at a horizontal distance d1 on the other side however.

An essential part of the apparatus is, as described above, that an inductor is positioned directly above the production pipe. Furthermore, types of circuitry (FIGS. 5 and 6) are specified in combination with inductor positionings (FIGS. 8, 9, 10), which enable a variation of the current feed distribution and thus heating output distribution between the inductor directly above the production pipe and further inductors remote therefrom. The EMGD method can thus be implemented particularly advantageously, as described below.

The EMGD can be subdivided into three phases. Phase 1 forms the heating of the reservoir without bitumen being conveyed. The bitumen melts here in the direct vicinity of the inductors. The melted regions are still insulated from one another and there is also no connection to the production pipe. In Phase 2, the bitumen is in the vicinity of the inductor, which is directly above the production pipe and is melted over such a wide area that there is a connection to the production pipe. The bitumen is conveyed from this central reservoir region with an accompanying pressure relief. There is also no connection with the melted regions of the outside inductors.

In phase 3, the central and external melted regions have connected with one another, accompanied by a pressure relief in the outer regions. The bitumen is conveyed from the whole reservoir until it is fully extracted.

To advantageously embody the EMGD, in Phase 1, the heating output is concentrated on the inductor directly above the production pipe in order to achieve as early a conveying start as possible. A continual or gradual displacement of the heating output components from the central region into the outer regions takes place in the subsequent phases 2 and 3, allowing for the compressive strength of the respective reservoir region. This requires different procedures depending on the type of circuitry and the positioning of the inductor.

In the configuration according to FIG. 8, different, separately controllable generators are used to feed current from A, A' and B, B'. An independent heating of the central region and the outer regions is thus possible depending on requirements by controlling the corresponding generators.

With the configurations according to FIGS. 9 and 10 in combination with the circuitry according to FIG. 6, the heating outputs applied to the central region and the outer regions are not independent of one another, but can also be adjusted within limits by the following modes of operation:

To maximize concentration of the heating output component on the central region (advantageous in Phase 1), inductor A and inductors B and C are to be operated as a forward conductor and return conductors respectively. The generator is used here as an alternating current source and the phase displacement between A and B, C amounts to 180°. With a homogenous electrical conductivity of the reservoir, the heating output components are ½ (A, central region) to ¼ (B), ¼ (C).

With a current feed having the same amplitude and 120° phase displacement (three-phase current), a uniform heating output entry of ⅓ of the overall heating output for A, B and C is obtained, this being advantageously useable in phases 2 and 3.

After adequately heating the central region, no further heating output is to be introduced there and the current feed of the inductor A can (at least partially) be completely discontinued. To this end, operation takes place as an alternating current generator with an inductor B as a forward conductor and inductor C as a return conductor. The heating pipe components are 0 for A and ½ for B, C in each instance.

According to the demands on the heating output distribution of the EMGD phases, one of the above modes of operation i)-iii) is set. It is also possible to switch repeatedly between these modes of operation within the EMGD phases.

Other amplitude ratios and phase displacements are also conceivable as a modification of the mode of operation ii), it being possible for said amplitude ratios and phase displacements to also result in asymmetrical heating output distributions if the reservoir conditions so require this. In the extreme case, it is possible to leave one of the external inductors (B or C) without current and to feed current to A as a forward conductor and C or B as return conductors, wherein the generator only needs to supply alternating current.

The invention claimed is:

1. A method for in-situ conveying of bitumen or very heavy oil from sand deposits as resevoirs by applying thermal energy to the reservoir in order to reduce the viscosity of the bitumen or very heavy oil, the method comprising:

heating and liquefying the bitumen or very heavy oil by means of a inductive conductor loop, to such a degree that it is in a condition to be led away using an extraction pipe:

compensating the inductivity of the inductive conductor loop section by section; and arranging the inductive conductor loop and the extraction pipe relative to one another such that an extraction rate is maximized, wherein the inductive conductor loop is subdivided into three inductive sub-condustors, wherein a plurality of currents in the three inductive sub-conductors are routed with a predetermined phase displacement, wherein adjusted inductor currents are selected in different phases of the method, according to a plurality of modes of operation, in order to adjust advantageous heating output distributions, wherein a first mode of operation is defined as including one inductive sub-conductor as a forward conductor and two inductive sub-conductors as return conductors and uses a generator as an alternating current source and a phase displacement between the three inductive sub-conductors is 120°, wherein a second mode of operation includes a current feed having a same amplitude and 120° phase displacement, three phase current, a uniform heating output for the three inductive subconductors is obtained, and wherein a third mode of operation includes at least partially discontinuing one inductive sub-conductor, using one inductive sub-conductor as a forward conductor and one inductive sub-conductor as a return conductor.

2. The method as claimed in claim 1, wherein the extraction pipe and inductive conductor loop are essentially routed in parallel.

3. The method as claimed in claim 1, wherein in the heating phase of the method, a heating output is concentrated on a central region, which is heated by an inductive sub-conductor arranged essentially above a production pipe.

4. The method as claimed in claim 3, wherein during conveying of bitumen from the central region, approximately the same heating outputs are induced through the three inductive sub-conductors, which may be achieved using the second mode of operation.

5. The method as claimed in claim 3, wherein during conveying of bitumen from outer regions of the reservoir, heating output is only or predominantly induced by the two external inductive sub-conductors, which may be achieved with an alternating current operation, without the second mode of operation being reached.

6. A device for use in a reservoir or deposit for bitumen and/or very heavy oil to convey bitumen or very heavy oil from oil sand deposits or reservoir, comprising:

at least two linearly extended conductors, wherein the at least two linearly extended conductors are routed in parallel in a horizontal alignment at a predetermined depth of the reservoir, wherein a plurality of ends of the conductors are electrically conductively connected inside or outside of the reservoir and together form a conductor loop which realizes a predetermined complex resistance and are connected outside of the reservoir to an external alternating current generator for electrical power, and wherein an inductivity of the conductor loop is compensated section by section and with one of the conductors of the conductor loop arranged essentially at a right angle above production pipe.

7. The device as claimed in claim 6, wherein a lateral deviation of the conductor loop from, a perpendicular arrangement above the production pipe is less than 10 m.

8. The device as claimed in claim 7, wherein the lateral deviation of the conductor loop from the perpendicular arrangement above the production pipe is less than 5 m.

9. The device as claimed in claim 6, wherein the at least two conductors are routed at different depths of the reservoir laterally displaced at a first predetermined distance.

10. The device as claimed in claim 6, wherein the at least two conductors are routed at different depths of the reservoir, one above the other without a lateral displacement at a second predetermined distance.

11. The device as claimed in claim 6, wherein a first inductive sub-conductor is used as a forward conductor and a second inductive sub-conductor is used as a return conductor, with forward and return conductors carrying the same intensity of current with a phase displacement of 180°.

12. The device as claimed in claim 6, wherein an inductive sub-conductor is used as a forward conductor and two inductive sub-conductors are used as return conductors, and wherein the two return conductors carry half the intensity of current with 180° phase displacement with respect to a current of the forward conductor.

13. The device as claimed in claim 12, wherein three inductive sub-conductors carry the same intensity of current and the phase displacements between the inductive sub-conductors are in each instance 120°.

14. The device as claimed in claim 13, wherein the three inductive sub-conductors are fed on an input side by a rotating current generator and are connected on an output side in a star point.

15. The device as claimed in claim 12, wherein three inductive sub-conductors carry uneven intensities of current and have a phase displacement other than 120°, and wherein intensities of current and phase displacements are selected such that circuitry with a star point is enabled.

16. The device as claimed in claim 6, wherein an inductive sub-conductor is used as a forward conductor and more than two inductive sub-conductors are used as return conductors, and wherein the phase displacement of the currents of the forward conductor to all return conductors amounting to 180° and a total of the return line currents corresponding to a forward line current.

* * * * *